US009509041B2

(12) United States Patent
Yan

(10) Patent No.: US 9,509,041 B2
(45) Date of Patent: Nov. 29, 2016

(54) MOBILE COMMUNICATION DEVICE AND METHOD FOR MANUFACTURING SAME

(71) Applicant: Wei Yan, Shenzhen (CN)

(72) Inventor: Wei Yan, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 35 days.

(21) Appl. No.: 14/613,811

(22) Filed: Feb. 4, 2015

(65) Prior Publication Data

US 2016/0134010 A1 May 12, 2016

(30) Foreign Application Priority Data

Nov. 12, 2014 (CN) ..... 2014 2 0672845 U

(51) Int. Cl.

| | |
|---|---|
| ***H01Q 1/24*** | (2006.01) |
| ***H01Q 1/48*** | (2006.01) |
| ***H01Q 9/04*** | (2006.01) |
| ***H01Q 9/42*** | (2006.01) |
| ***H01Q 1/12*** | (2006.01) |

(52) U.S. Cl.

CPC ..... *H01Q 1/243* (2013.01); *H01Q 1/1207* (2013.01); *H01Q 1/48* (2013.01); *H01Q 9/0421* (2013.01); *H01Q 9/42* (2013.01)

(58) Field of Classification Search

CPC ..... H01Q 1/243
USPC ..... 343/702
See application file for complete search history.

*Primary Examiner* — Graham Smith
(74) *Attorney, Agent, or Firm* — Na Xu; IPro, PLLC

(57) ABSTRACT

A mobile communication device includes a metallic rear cover, a circuit board arranged within the rear cover and an antenna, the antenna including a radiation source connecting to the metallic rear cover and a circuitry portion on the circuit board, the circuitry portion including a feed portion connecting to the radiation source, a grounding portion, and a controlling circuitry for controlling the grounding portion to connect or disconnect to the radiation source. A corresponding method for manufacturing the mobile communication device is also presented.

9 Claims, 4 Drawing Sheets

MOBILE COMMUNICATION DEVICE AND METHOD FOR MANUFACTURING SAME

FIELD OF THE INVENTION

The disclosure described herein relates to the field of communication technologies, and more particularly to mobile communication devices and a method for manufacturing such a mobile communication device.

DESCRIPTION OF RELATED ART

Nowadays, a mobile communication device, such as a phone, or a tablet PC, with a metallic housing, is widely accepted and desired by users, by virtue of the fashion appearances. Compared with other housings made of other materials, metallic housings not only have a fashion appearance, but also have many other advantages, such as better stiffness, greater strength, thinner thickness, recyclable, better heat dissipation and so on.

A mobile communication device related to the present disclosure includes a metallic housing and an antenna received within the metallic housing. The metallic shell includes a metallic rear cover, a first metallic piece, and a second metallic piece connected with the first metallic piece. The first and second metallic pieces serve as a radiation part for the antenna in the metallic housing. However, the frequency band of the antenna is non-adjustable, therefore the mobile communication device cannot function well at a proper and desirable frequency band.

The present disclosure is accordingly provided to solve the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Figure 1:
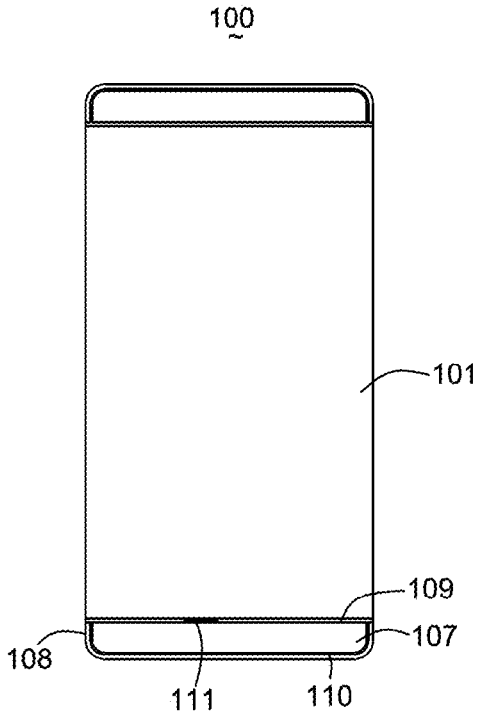
FIG. 1 is a rear view of a mobile communication device in accordance with an exemplary embodiment of the present disclosure.

The present invention will hereinafter be described in detail with reference to an exemplary embodiment.

Referring to FIGS. 1-5, a mobile communication device 100 in accordance with an exemplary embodiment of the present invention is provided. The mobile communication device 100 includes a metallic rear cover 101, a screen 102, a circuit board 103 received between the metallic rear cover 101 and the screen 102, and an antenna. The metallic rear cover 101 includes a main plate 101A parallel to the screen 10 and a side plate 101B extending from edges of the main plate 101A toward the screen 102, with the side plate 101B connected to the screen 102.

The antenna includes a radiation source connecting to the metallic rear cover 101 and a circuitry portion on the circuit board 103. The radiation portion includes a first metallic piece 107 and a second metallic piece 108. The first metallic piece 107 is parallel to the main plate 101A and connects with the main plate 101A. The second metallic piece 108 is perpendicular to the first metallic piece 107 and approximately C-shaped. The second metallic piece 108 connects to the side plate 101B, the first metallic piece 107, and the screen 102. The circuit board is accordingly enclosed by the first metallic piece 107, the metallic rear cover 101, the screen 102, and the second metallic piece 108.

Advantageously, the mobile communication device further includes an insulating frame 109 for forming isolations between any two of the metallic rear cover 101, the first metallic piece 107 and the second metallic piece 109. A first conductor 110 is positioned on the insulating frame 109 with one end thereof abutting against the first metallic piece 107 and the other end thereof abutting against the second metallic piece 108, so that the first metallic piece 107 and the second metallic piece 108 can be electrically connected to each other via the first conductor 110. Similarly, a second conductor 111 is also positioned on the insulating frame 109, for abutting against both of the main plate 101A and the first metallic piece 107. Advantageously, the first conductor 110 and the second conductor 111 are both metallic plates.

Figure 3:
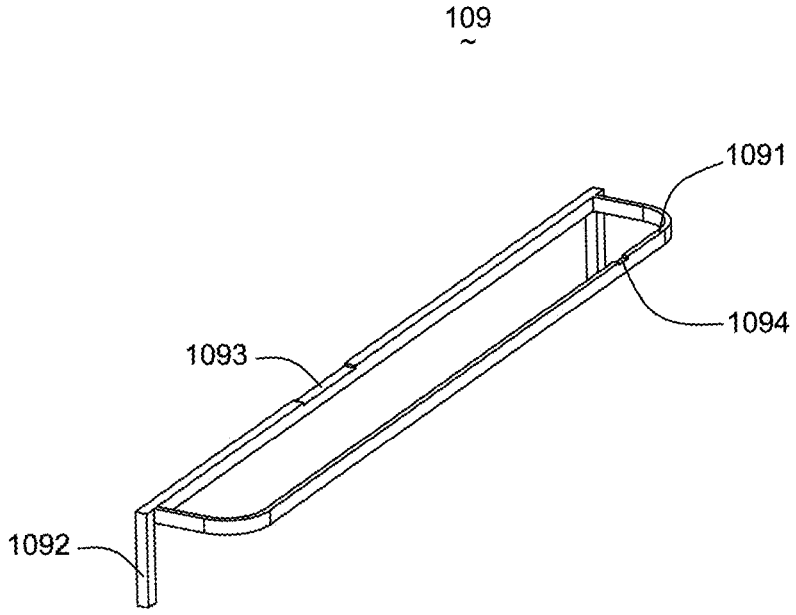
FIG. 3 illustrates a schematic block diagram of a circuitry portion used in the mobile communication device shown in FIG. 1.

Referring to FIG. 3, the insulating frame 109 includes a holding portion 1091 for supporting the first metallic piece 107 and an extending portion 1092 positioned between the metallic housing 101 and the second metallic piece 108. The extending portion 1092 extends perpendicularly to the holding portion 1091. In this case, the holding portion 1091 isolates the first metallic piece 107 from the metallic housing 101 and the second metallic piece 108, and the extending portion 1092 respectively abuts against the metallic rear cover 101, the screen 102 and the second metallic piece 108, so as to form isolations between the second metallic piece 108 and the metallic rear cover 101. Advantageously, a first slot 1094 and a second slot 1093 are formed in the holding portion 1091. Correspondingly, the first conductor 110 is arranged in the first slot 1094 and the second conductor 111 is arranged in the second slot 1093.

Figure 2:
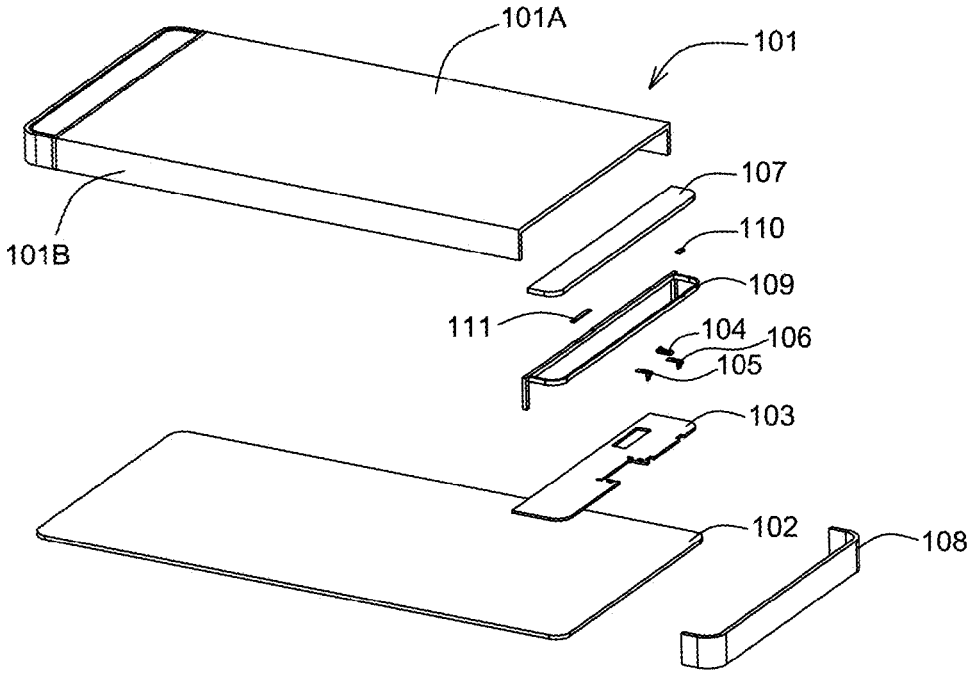
FIG. 2 is an exploded view of the mobile communication device shown in FIG. 1.
Figure 4:
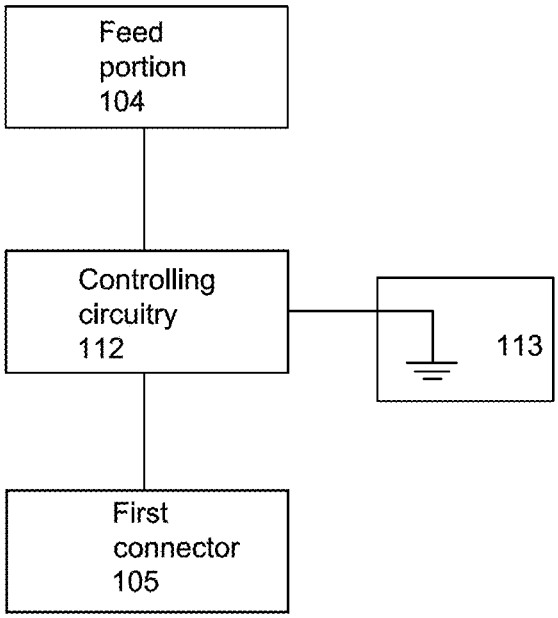
FIG. 4 illustrates an insulating frame used in the mobile communication device shown in FIG. 2.

As shown in FIG. 2 and FIG. 4, the circuitry portion on the circuit board 103 includes a feed portion 104 connecting to the radiation source, especially connecting to the second metallic piece 108, a grounding portion 113, and a controlling circuitry 112 connecting to the grounding portion 113. The controlling circuitry is grounded by the grounding portion 113. The controlling circuitry 112 also connects to the second metallic piece 108, for controlling the grounding portion 113 to connect or disconnect to the second metallic piece 108. Therefore, the controlling circuitry 112 can control the second metallic piece 108 to be grounded or not.

Referring to FIG. 2 together with FIG. 4, a first connector 105 and a second connector 106 are positioned on the circuit board 103. The first connector 105 connects to the controlling circuitry 112 and the second metallic piece 108. One end of the second connector 106 connects to the feed portion 104, and the other end of the second connector 106 connects to the second metallic piece 108.

Figure 5:
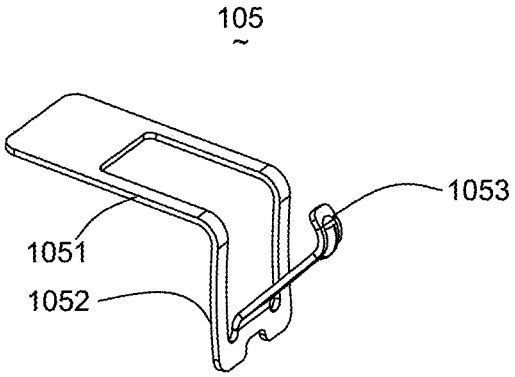
FIG. 5 illustrates a detailed view of a first connector used in the mobile communication device shown in FIG. 2.

FIG. 5 illustrates an exemplary structure of the first connector 105. Herein, the first connector 105 comprises a fixing part 1051 parallel with the main board 103, a snap part 1052 vertically extending from an end of the fixing part 1051 and a connecting part 1053 extending from an end of the snap part 1052 in a direction away from the snap part 1052 and towards the second metallic piece 108. The first connector 105 is fixed on the circuit board 103 to connect to the controlling circuitry by snap fitting, and the connecting part 1053 can be resilient so as to steadily abut against the second metallic piece 108. Accordingly, the second connector 106 can be provided with a similar structure to the first connector 105.

With the above-mentioned structure of the mobile communication device, the feed portion directly connects to the second metallic piece 108, and thus the first metallic piece 107 and the second metallic piece 108 function as a radiator of the antenna. The controlling circuitry 112 on the circuit board can control the connecting between the second metallic piece 108 and the grounding portion 113.

Correspondingly, a manufacturing method for the mobile communication device mentioned above is also provided in this disclosure. The method includes the steps as follows.

Firstly, a metallic rear cover 101 and a circuit board 103 are provided. A screen 102 is connecting to the metallic rear cover 101, and the circuit board 103 is to be arranged in the metallic rear cover 101.

Then, an antenna portion is to be formed by providing a radiation source and a circuitry portion. The radiation source comprises a first metallic piece 107 connecting to the metallic rear cover 101, and a second metallic piece 108 connecting to the first metallic piece 107 and the metallic rear cover 101. The circuitry portion is positioned on the circuit board 103 by providing the circuit board 103 with a feed portion 104 connecting to the radiation source, a grounding portion 113, and a controlling circuitry 112 for controlling the grounding portion 113 to connect or disconnect with the second metallic piece 108.

Furthermore, an insulating frame 109 is arranged for forming isolations between any two of the metallic rear cover 101, the first metallic piece 107 and the second metallic piece 108. A first conductor 110 is positioned on the insulating frame 109 for electrically connecting the first metallic piece 107 to the second metallic piece 108. Additionally, the first metallic piece 107 is grounded.

In an optional step, a second conductor 111 is positioned on the insulating frame 109 to electrically connect the first metallic piece 107 to the metallic rear cover 101. A first connector 105 is positioned on the circuit board 103, for connecting the controlling circuitry 112 to the second metallic piece 108, and the controlling circuitry 112 is grounded by the grounded portion.

In another optional step, a second connector 106 may also be positioned on the circuit board for connecting the feed portion 104 to the second metallic piece 108. For example, one end of the second connector 106 connects to the feed portion 104, and the other end of the second connector 106 connects to the second metallic piece 108.

Figure 6:
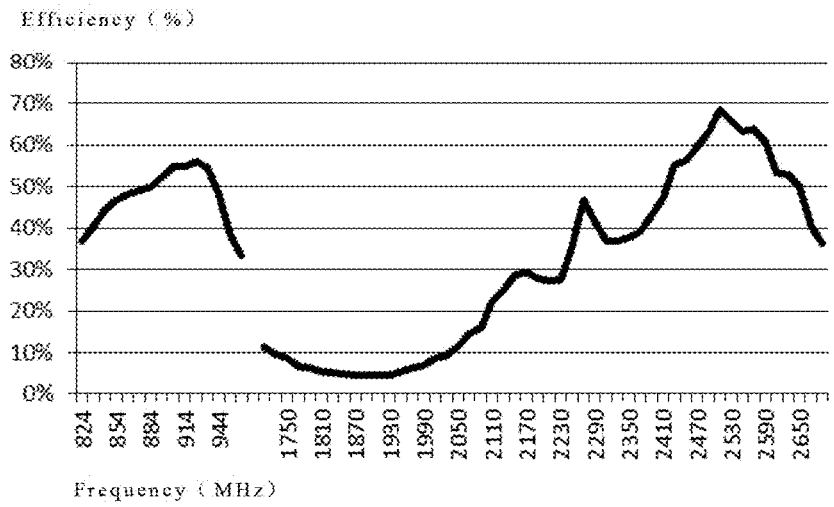
FIG. 6 illustrates the performance of the mobile communication device in FIG. 2 in one state.

Referring to FIG. 6, when the circuitry portion 112 controls the second metallic piece 108 to disconnect with the grounding portion 113, that is the second metallic piece 108 is not grounded, by adjusting positioning the first conductor 110 and second conductor 111 on the insulting frame 109 to tune the antenna, it is possible to acquire a frequency band of 824-960 MHz and/or 2330-2690 MHz.

Figure 7:
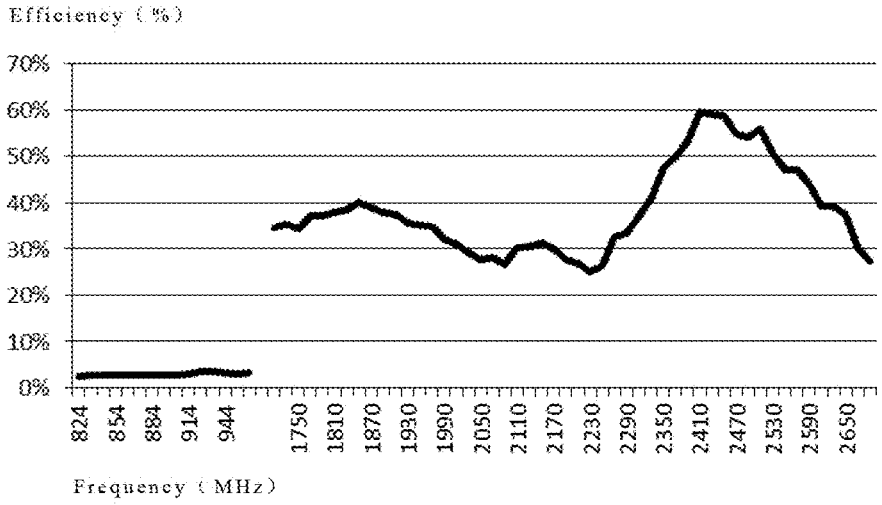
FIG. 7 illustrates the performance of the mobile communication device in FIG. 2 in another state.

Referring to FIG. 7, when the circuitry portion 112 controls the second metallic piece 108 to connect with the grounding portion 113, that is the second metallic piece 108 is grounded, by adjusting positioning the first connector 105 on the circuit board to tune the antenna, it is possible to acquire a frequency band of 1710-2170 MHz.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile communication device, consisting essentially of:

a metallic rear cover having a planar main plate and a side plate perpendicularly extending from a edge of the metallic rear cover, a circuit board arranged within the rear cover and an antenna;

the antenna consisting essentially of a radiation source connecting to the metallic rear cover and a circuitry portion on the circuit board;

the radiation source, functioning as a radiator of the antenna, consisting essentially of a first metallic piece connecting to the metallic rear cover, a second metallic piece connecting to the first metallic piece and the metallic rear cover, an insulating frame for generating an isolation between any two of the metallic rear cover, the first metallic piece and the second metallic piece, with narrow slots formed between the second metallic piece and the sidewalls, and a first conductor positioned on the insulating frame for electrically connecting the first metallic piece to the second metallic piece;

wherein, the first metallic piece is perpendicular to the second metallic piece and parallel to the planar main plate, the first metallic piece and the second metallic piece are planar and elongated, the second metallic piece forms a end wall of the mobile communication device, and the first metallic piece and the second metallic piece are located with respect to each other such that forms a narrow and elongated gap that is spanned only by the first conductor;

the circuitry portion consisting essentially of a feed portion connecting to the radiation source, a grounding portion, and a controlling circuitry for controlling the grounding portion to connect or disconnect to the second metallic piece, the feed portion connecting to the second metallic piece of the radiation source.

2. The mobile communication device as described in claim 1, wherein the metallic rear cover is grounded, and a second conductor is positioned on the insulating frame to electrically connect the first metallic piece to the metallic rear cover.

3. The mobile communication device as described in claim 2, wherein the insulating frame comprises a holding portion for supporting the first metallic piece, and an extending portion sandwiched between the metallic housing and the second metallic piece, extending perpendicularly to the holding portion.

4. The mobile communication device as described in claim 3, wherein, a first connector is arranged on the circuit board, for connecting the controlling circuitry to the second metallic piece.

5. The mobile communication device as described in claim 4, wherein, a second connector is arranged on the circuit board, for connecting the feed portion to the second metallic piece.

6. A method for manufacturing the mobile communication device as claimed in claim 1, consisting essentially of the steps of:

providing a metallic rear cover and a circuit board received in the metallic rear cover;

forming an antenna by providing a radiation source and a circuitry portion, the radiation source consisting essentially of a first metallic piece connecting to the metallic rear cover, and a second metallic piece connecting to the first metallic piece and the metallic rear cover, the circuitry portion is positioned on the circuit board by providing the circuit board with a feed portion connecting to the radiation source, a grounding portion, and a controlling circuitry for controlling the grounding portion to connect or disconnect with the second metallic piece;

generating an isolation between any two of the metallic rear cover, the first metallic piece and the second metallic piece by an insulating frame;

positioning a first conductor on the insulating frame to electrically connect the first metallic piece to the second metallic piece.

7. The method for manufacturing the mobile communication device as described in claim 6, further consisting essentially of steps of:

positioning a second conductor on the insulating frame to electrically connect the first metallic piece to the metallic rear cover;

and positioning a first connector on the circuit board, for connecting the controlling circuitry to the second metallic piece, wherein the controlling circuitry is grounded by the grounded portion.

8. The method for manufacturing the mobile communication device as described in claim 7, further consisting essentially of steps of:

via the circuitry portion, controlling the second metallic piece to connect with the grounding portion;

adjusting the first connector's positioning on the circuit board to tune the antenna to acquire a frequency band of 1710-2170 MHz.

9. The method for manufacturing the mobile communication device as described in claim 7, further consisting essentially of steps of:

via the circuitry portion, controlling the second metallic piece to disconnect with the grounding portion;

adjusting the first and second conductors' position on the insulting frame for tuning the antenna to acquire a frequency band of 824-960 MHz and/or 2330-2690 MHz.

* * * * *